United States Patent [19]

Ortwein

[11] Patent Number: 5,060,856

[45] Date of Patent: Oct. 29, 1991

[54] SOUND-DAMPING MAT, ESPECIALLY FOR A BALLAST BED

[76] Inventor: Hermann Ortwein, Niehler Kirchweg 155, D-5000 Köln 60, Fed. Rep. of Germany

[21] Appl. No.: 626,322

[22] Filed: Dec. 13, 1990

Related U.S. Application Data

[63] Continuation of Ser. No. 362,881, Jun. 7, 1989, abandoned.

[51] Int. Cl.[5] ..... E01B 19/00

[52] U.S. Cl. ..... 238/382; 238/283; 238/2

[58] Field of Search ..... 238/283, 382, 1, 2; 181/289, 290, 291

[56] References Cited

U.S. PATENT DOCUMENTS

| | | | |
|---|---|---|---|
| 4,056,161 | 11/1977 | Allen, Jr. | 181/290 |
| 4,235,371 | 11/1980 | Kohler | 238/382 |
| 4,247,586 | 1/1981 | Rochlin | 181/284 X |
| 4,403,677 | 9/1983 | Messinger | 181/290 X |
| 4,500,037 | 2/1985 | Braitsch et al. | 238/382 X |
| 4,627,199 | 12/1986 | Capaul | 181/291 X |
| 4,696,429 | 9/1987 | Ortwein | 238/382 X |
| 4,720,043 | 1/1988 | Ortwein | 238/2 |
| 4,848,514 | 7/1989 | Snyder | 181/222 X |

FOREIGN PATENT DOCUMENTS

| | | |
|---|---|---|
| 3121946 | 12/1982 | Fed. Rep. of Germany . |
| 3425647 | 1/1986 | Fed. Rep. of Germany . |
| 3506505 | 8/1986 | Fed. Rep. of Germany . |

OTHER PUBLICATIONS

A. Reisfeld, *Warp Knit Engineering,* 1966 Copyright, Chapter 1.

*Primary Examiner*—Robert J. Oberleitner
*Assistant Examiner*—Alfred Muratori
*Attorney, Agent, or Firm*—Herbert Dubno

[57] ABSTRACT

The upper part of an elastomeric mat acting as a sound-damping element below a bed of ballast in a track support assembly is provided with a single layer of a knit, preferably a multiaxial warp knit fabric which, in part, protects the body of the mat against deterioration by penetration of the stones therethrough and provides high tensile strength in substantially all directions for the mat.

17 Claims, 2 Drawing Sheets

SOUND-DAMPING MAT, ESPECIALLY FOR A BALLAST BED

This is a continuation of co-pending application Ser. No. 07/362,881 filed on 7 June 1989, now abandoned.

CROSS REFERENCE TO RELATED APPLICATIONS

This application is related to the copending application Ser. No. 07/205,428 filed 10 June 1988 now U.S. Pat. No. 4,915,298.

FIELD OF THE INVENTION

My present invention relates to a sound-damping mat composed of an elastic material and adapted to form a sound-damping or support for a bed of ballast used to hold in place the ties or sleepers of railroad rails and the like. More particularly, the invention relates to a mat of this type which may be provided with projections on its underside and which can have at least one layer composed of a different material on its upper surface engaged by the stones of the ballast bed.

BACKGROUND OF THE INVENTION

In connection with underlayment for beds of ballast, reference may be had to my earlier patents: U.S. Pat. No. 4,775,103 issued 4 Oct. 1988; U.S. Pat. No. 4,720,043 issued 19 Jan. 1988; U.S. Pat. No. 4,696,429 issued 29 Sept. 1987; U.S. Pat. No. 4,577,801 issued 25 Mar. 1986 and U.S. Pat. No. 4,527,736 issued 9 July 1985.

In a prior mat construction of the above described type, the upper layer mat is formed by a plastically deformable material, for example a bitumen layer (see German Utility Model DE-GM 8013779). In this system, the stones of the ballast bed can penetrate to various degrees into the bitumen layer so that the ballast bed is stabilized against slippage relative to the underlayment. This underlayment, however, has the drawback that sharp-edged ballast stones readily penetrate through the bitumen layer into the elastomeric layer underlying same and cause deterioration of the mat so that, after a time, the entire mat is granulated and no longer has sound-damping properties.

Another mat used as an underlayment for a ballast bed is provided on its upper surface with a sheet metal layer intended to prevent penetration of the ballast into the mat. A mat of this type is described in German Open Application DE-OS 3,121,946. This mat does indeed provide an especially high degree of sound-damping, but has low flexibility so that its emplacement poses a problem. In practice, the mat can only be laid down in relatively short lengths.

In the underlayment described in German Open Application DE-OS 3 425 647 (U.S. Pat. No. 4,696,429), the layer overlying the elastomeric body of the mat is a woven fabric while in German Open Application DE-OS 3 506 505, this layer is a nonwoven fleece.

These mats also provide high degrees of sound damping or, stated otherwise, reduced sound transmission through the solid body of the underlayment. (i.e. noise damping) However, they also require multiple layers to form the upper surface. For example, when a woven fabric is used for the upper part of the mat, two or more layers of fabric are required.

The layers contribute tensile strength to the mats only in the directions in which they extend so that with two layers, for example, tensile strength is provided only in two directions at a right angle to one another. The modulus of the elasticity can also be controlled only in two directions when two woven fabric layers are provided in the manner described.

In general, therefore, I have found that in spite of the high degree of sound-damping which can be obtained utilizing these earlier systems, the systems themselves require improvement.

OBJECTS OF THE INVENTION

It is, therefore, the principal object of the present invention to provide an improved sound-damping mat which can be used as an underlayment for a ballast bed as described in the last mentioned patent documents, but which will have improved characteristics by comparison with the earlier underlayment.

Another and more specific object is to provide an underlayment for a ballast bed which will resist penetration by the ballast and will have controlled modulus of elasticity in a greater number of directions and multiaxial tensile strength.

Still another object of this invention is to provide a rail support assembly which includes an improved underlayment.

A further object of this invention is to provide an improved underlayment for the purposes described which has a simpler construction then underlayments which have hitherto required multiple layers of the material used for the upper part of the mat.

SUMMARY OF THE INVENTION

These objects and others which will become apparent hereinafter are attained, in accordance with the invention by providing the layer at the upper part of the mat as a knit layer and preferably a warp knit layer, most advantageously as a single warp knit layer.

According to the invention, therefore, the improved underlayment for a ballast bed comprises:

- a base layer of an elastic material having an upper side and a lower side; and
- a knit layer on the upper side of the base layer.

The rail support assembly of the invention thus will comprise:

- a sound-damping mat, comprising a base layer of an elastic material having an upper side and a lower side, and a warp knit layer on the upper side of the base layer, the lower side being formed with projections engageable with a supporting surface;
- a railroad tie supported on the mat;
- at least one rail mounted on the tie; and
- a bed of ballast around the tie on the mat.

The mat of the invention has the important advantage that simply with the provision of a single warp knit layer, it is possible to control the tensile strength and stiffness of the mat in a variety of directions at will so that, for example, the tensile strength and stiffness can be different in different directions.

As a consequence, the mat construction can be varied to suit any desired application. The mat of the invention also has the advantage that it provides a better distribution of the compression forces acting thereon over the supporting surface. Advantageously, the warp knit layer is formed of a multiaxial warp knit fabric. Such a fabric has been found to have a high degree of adaptability to the requirements of a wide variety of applications of the underlayment. It is important to the invention and hence a feature thereof that only a single layer of the warp knit fabric be provided.

According to another feature of the invention, the warp knit fabric is constituted from a water-resistant and moisture resistant nonrotting synthetic fiber material, especially a polyester and/or a polyamide. According to another feature of the invention the warp knit fabric is constituted at least predominantly of glass fibers.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
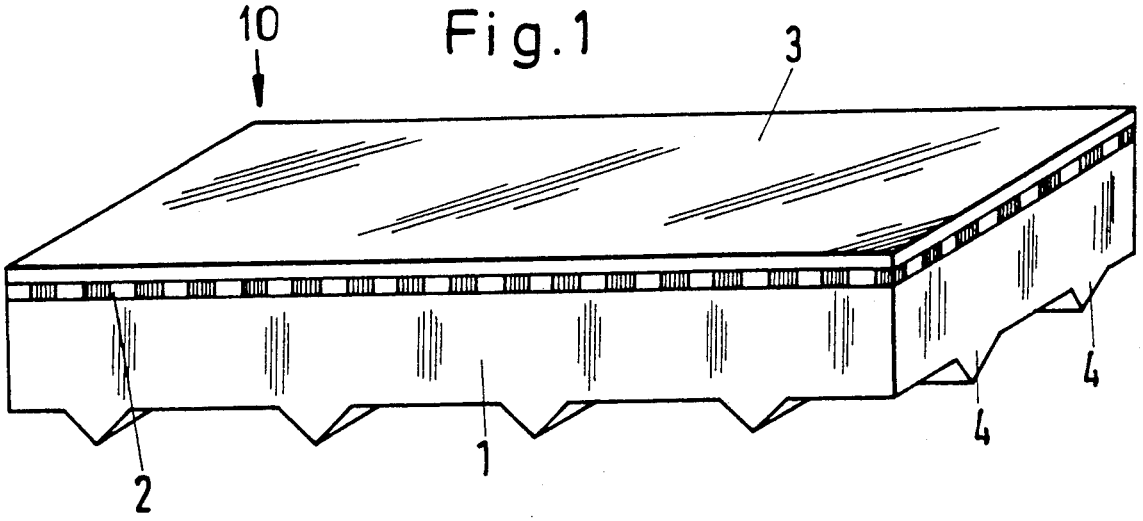
FIG. 1 is a perspective view of a portion of a mat embodying the invention.
Figure 2:
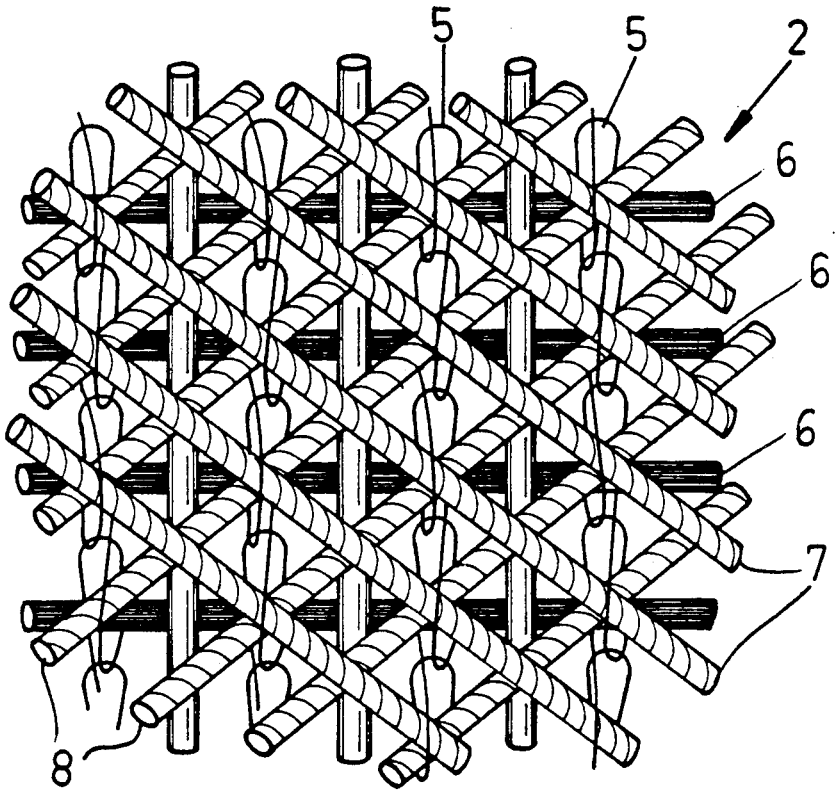
FIG. 2 is a plan view diagrammatically showing a detail of the knit fabric which is used.
Figure 3:
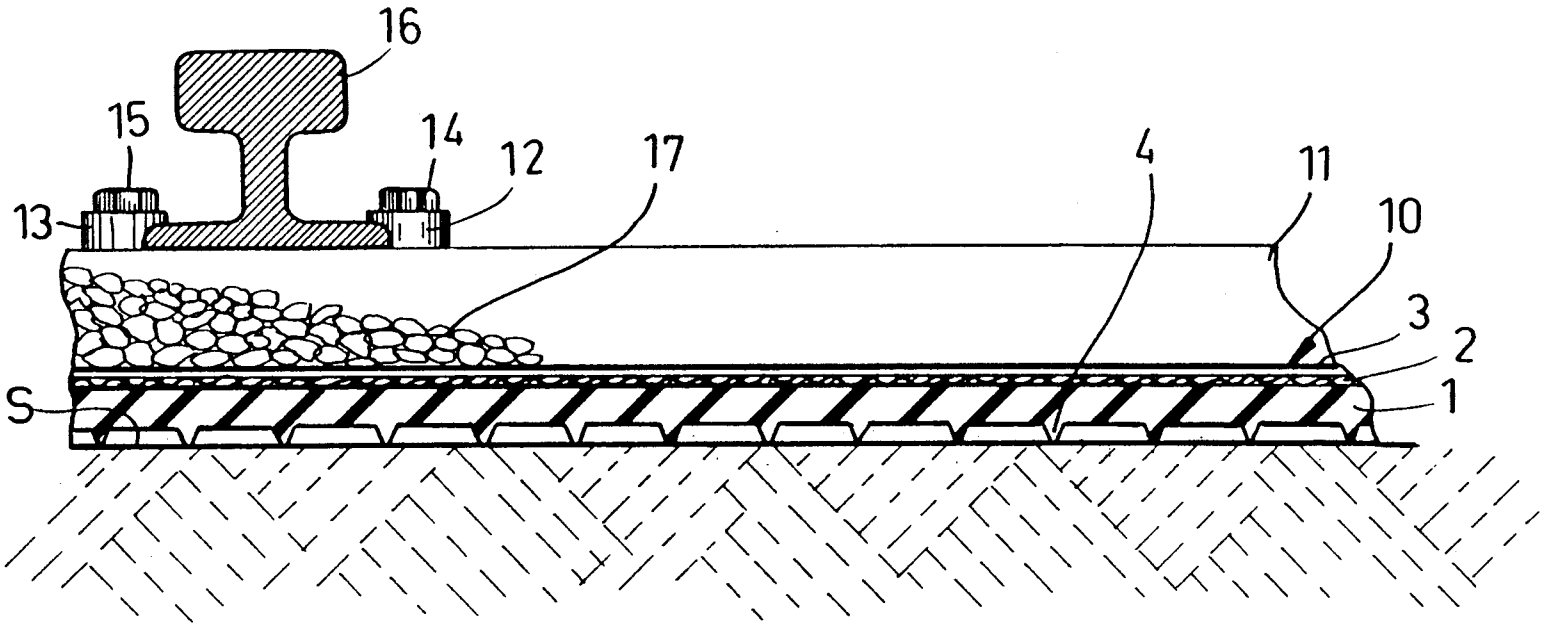
FIG. 3 is a cross sectional view through a rail assembly utilizing the underlayment of the invention.

AS can be seen from FIG. 1, the mat 10 comprises an elastomeric body 1, the underside of which is formed with mutually perpendicular rows of downwardly converging ribs 4 forming projections which support the mat on a support surface shown at S in FIG. 3. Bonded to the upper side of the body 1 is a multiaxial warp knit fabric 2 shown in greater detail in FIG. 2. Bonded to the upper surface of the single layer 2 of the fabric, is a cover plate 3 which may consist of a further elastomer layer or may be a thin metal sheet.

In FIG. 2 I have shown the fabric in the form of a multiaxial warp knit which consists, in the usual manner, of parallel warp columns 5 into corresponding loops of which, weft yarns 6 are inlaid to run perpendicular to the warp columns. In addition, two sets of mutually parallel diagonally running yarns 7 and 8 extend with opposite inclinations through successive loops of successive columns in the manner shown in FIG. 2.

As a result, the fabric FIG. 2 in a single layer provides tensile strength in a multiplicity of directions including the directions in which the weft and diagonal yarns run and, of course, the directions of the warp columns. The weft and diagonal yarns constitute a filling for the loops stabilizing the fabric.

As can be seen from FIG. 3, the mat 10 is placed on a support S and, in turn, carries a bed 17 of ballast holding in place the sleeper or tie 11. Chocks 12 and 13 via bolts 14 and 15 clamp the base of a rail 16 against the tie.

As can be seen from FIG. 3, therefore, the knit layer 2 as described in connection with FIGS. 1 and 2 is interposed between the bed 17 of ballast stones and the body 1 of the mat 10.

The single knit fabric layer 3, by virtue of its multiaxial construction provides high tensile strength in substantially all directions for the mat 10 and also protects the body 1 of the mat against deterioration by edges of the ballast stones which are supported by the mat.

I claim:

1. A noise-damping mat for an underlayment for a bed of ballast, comprising:

a base layer of an elastic material having an upper side engageable by the ballast of said bed and a lower side formed with projections engageable with a supporting surface; and a knit layer on said upper side of said base layer as an exclusive fabric layer on said upper side of said base layer.

2. The noise-damping mat defined in claim 1 wherein said knit layer is a warp knit.

3. The noise-damping mat defined in claim 2 wherein said warp knit is a multiaxial warp knit layer.

4. A noise-damping mat, for an underlayment for a bed of ballast, comprising:

a base layer of an elastic material having an upper side and a lower side; and a multiaxial warp knit layer on said upper side of said base layer, said multiaxial warp knit having knit warp columns linked by weft yarns inlaid into corresponding knit loops of said columns and two oppositely inclined arrays of mutually parallel diagonal yarns laid into successive knit loops of successive columns.

5. The noise-damping mat defined in claim 4 wherein said warp knit is composed of a water-resistant and moisture-resistant nonrotting synthetic fiber.

6. The noise-damping mat defined in claim 5 wherein said synthetic fiber is a polyester or polyamide fiber.

7. The noise-damping mat defined in claim 4 wherein said warp knit is composed at least predominantly of glass fiber.

8. A noise-damping mat, for an underlayment for a bed of ballast, comprising:

a base layer of an elastic material having an upper side and a lower side; and a multiaxial warp knit layer on said upper side of said base layer, said lower side being formed with projections engageable with a supporting surface, said multiaxial warp knit having knit warp columns linked by weft yarn inlaid into corresponding knit loops of said columns and two oppositely inclined arrays of mutually parallel diagonal yarns laid into successive knit loops of successive columns.

9. The noise-damping mat defined in claim 8 wherein said warp knit is composed of a water-resistant and moisture-resistant nonrotting synthetic fiber.

10. The noise-damping mat defined in claim 9 wherein said synthetic fiber is a polyester or polyamide fiber.

11. The noise-damping mat defined in claim 8 wherein said warp knit is composed at least predominantly of glass fiber.

12. A rail assembly comprising:

a noise-damping mat, comprising a base layer of an elastic material having a ballast-containing upper side and a lower side formed with projections engageable with a supporting surface, and a warp knit layer on said upper side of said base layer as an exclusive fabric layer on said upper side of said base layer;

a railroad tie supported on said mat;

at least one rail mounted on said tie; and a bed of ballast around said tie on said upper side of said mat.

13. The rail assembly defined in claim 12 wherein said warp knit is a multiaxial warp knit layer.

14. A rail assembly comprising:

a noise-damping mat, comprising a base layer of an elastic material having an upper side and a lower side, and a multiaxial warp knit layer on said upper side of said base layer, said lower side being formed with projections engageable with a supporting surface;

a railroad tie supported on said mat;

at least one rail mounted on said tie; and a bed of ballast around said tie on said mat; said multiaxial warp knit having knit warp columns linked by weft yarns inlaid into corresponding knit loops of said columns and two oppositely inclined arrays of mutually parallel diagonal yarns laid into successive knit loops of successive columns.

15. The noise-damping mat defined in claim 14 wherein said warp knit is composed of a water-resistant and moisture-resistant nonrotting synthetic fiber.

16. The noise-damping mat defined in claim 15 wherein said synthetic fiber is a polyester or polyamide fiber.

17. The noise-damping mat defined in claim 14 wherein said warp knit is composed at least predominantly of glass fiber.

* * * * *